US007381299B2

(12) United States Patent
Shannon et al.

(10) Patent No.: US 7,381,299 B2
(45) Date of Patent: Jun. 3, 2008

(54) APERTURED TISSUE PRODUCTS

(75) Inventors: Thomas Gerard Shannon, Neenah, WI (US); David Andrew Moline, Appleton, WI (US); Tammy Jo Balzar, Oshkosh, WI (US); Jeffrey David Mathews, Neenah, WI (US); John J. Urlaub, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 705 days.

(21) Appl. No.: 10/866,218

(22) Filed: Jun. 10, 2004

(65) Prior Publication Data

US 2005/0274470 A1 Dec. 15, 2005

(51) Int. Cl.
*B32B 3/24* (2006.01)
*D21H 27/30* (2006.01)

(52) U.S. Cl. ..... 162/125; 162/158; 162/109; 162/117; 162/135; 428/537.5

(58) Field of Classification Search ..... 162/109, 162/111–113, 117, 123–133, 158, 205; 428/156, 428/195.1, 172, 174, 537.5, 211.1, 61, 297; 424/401–402
See application file for complete search history.

(56) References Cited

U.S. PATENT DOCUMENTS 3,485,706 A * 12/1969 Evans ..... 428/134
3,549,742 A * 12/1970 Benz ..... 264/250
3,817,827 A * 6/1974 Benz ..... 162/113
3,881,987 A 5/1975 Benz
3,949,127 A * 4/1976 Ostermeier et al. ..... 428/137
4,357,827 A 11/1982 Mcconnell
4,950,545 A 8/1990 Walter et al.
5,227,242 A 7/1993 Walter et al.
5,558,873 A 9/1996 Funk et al.
5,562,646 A 10/1996 Goldman et al.
5,601,871 A * 2/1997 Krzysik et al. ..... 427/288
5,628,097 A * 5/1997 Benson et al. ..... 28/165
5,658,639 A * 8/1997 Curro et al. ..... 428/131
5,704,101 A * 1/1998 Majors et al. ..... 26/18.6
5,722,966 A 3/1998 Christon et al.
5,763,044 A 6/1998 Ahr et al.
5,779,860 A 7/1998 Hollenberg et al.
5,830,555 A * 11/1998 Srinivasan et al. ..... 428/137
5,885,697 A * 3/1999 Krzysik et al. ..... 428/211.1
5,925,026 A 7/1999 Arteman et al.
5,990,377 A * 11/1999 Chen et al. ..... 604/381
6,027,611 A 2/2000 Mcfarland et al.
6,054,020 A 4/2000 Goulet et al.
6,231,719 B1 5/2001 Garvey et al.
6,261,679 B1 * 7/2001 Chen et al. ..... 428/317.9
6,368,609 B1 * 4/2002 Fontenot et al. ..... 424/404
6,395,957 B1 5/2002 Chen et al.
6,432,270 B1 8/2002 Liu et al.
6,491,928 B1 12/2002 Smith, III
6,492,574 B1 12/2002 Chen et al.
6,548,732 B2 4/2003 Erdman et al.
6,582,560 B2 6/2003 Runge et al.
6,603,054 B2 * 8/2003 Chen et al. ..... 604/369
6,911,573 B2 * 6/2005 Chen et al. ..... 604/378
7,029,756 B2 * 4/2006 Moline et al. ..... 428/452
2002/0103469 A1 * 8/2002 Chen et al. ..... 604/374
2002/0112835 A1 8/2002 Liu et al.
2003/0028985 A1 2/2003 Prodoehl et al.
2003/0131960 A1 * 7/2003 McConnell et al. ..... 162/127
2004/0084165 A1 * 5/2004 Shannon et al. ..... 162/158
2004/0086726 A1 5/2004 Moline et al.
2004/0118531 A1 * 6/2004 Shannon et al. ..... 162/109
2004/0118532 A1 6/2004 Sarbo et al.
2004/0123962 A1 7/2004 Shannon et al.
2004/0144507 A1 * 7/2004 Shannon et al. ..... 162/9
2004/0163785 A1 8/2004 Shannon et al.
2005/0274470 A1 * 12/2005 Shannon et al. ..... 162/125

FOREIGN PATENT DOCUMENTS

WO WO 2003/011585 A1 2/2003

OTHER PUBLICATIONS

American Society for Testing Materials (ASTM) Designation: D5725-99, "Surface Wettability and Absorbency of Sheeted Materials Using an Automated Contact Angle Tester," pp. 794-800, published May 1999.
American Society for Testing Materials (ASTM) Designation: D5946-96, "Corona-Treated Polymer Films Using Water Contact Angle Measurements," pp. 720-724, published Jun. 1996.
American Society for Testing Materials (ASTM) Designation: D724-99, "Surface Wettabiliyt of Paper(Angle-of-Contact Method)," pp. 66-69, published May 1999.
American Society for Testing Materials (ASTM) Designation: C813-90, "Hydrophobic Contamination on Glass by Contact Angle Measurement," pp. 263-264, published Jan. 1991.
TAPPI Official Test Method T 411 om-89, "Thickness (Caliper) of Paper, Paperboard, and Combined Board," published by the TAPPI Press, Atlanta, Georgia, revised 1989, pp. 1-3.
TAPPI Official Test Method T 458 cm-94, "Surface Wettability of Paper(Angle of Contact Method)," published by the TAPPI Press, Atlanta, Georgia, 1994, pp. 1-6.
TAPPI Provisional Test Method T 530 pm-89, "Size Test for Paper By Ink Resistance (Hercules Method)," published by the TAPPI Press, Atlanta, Georgia, revised 1989, pp. 1-5.

* cited by examiner

*Primary Examiner*—José A. Fortuna
(74) *Attorney, Agent, or Firm*—Gregory E. Croft

(57) ABSTRACT

The fluid intake rate of a tissue product having at least one hydrophobic exterior layer can be increased significantly by the addition of apertures through the hydrophobic exterior layer to the tissue product's hydrophilic interior layer. The apertures allow for fluid to be absorbed by the hydrophilic interior layer, while leaving the hydrophobic exterior layer dry to the touch. The size, number and spacing of the apertures can be controlled to manage the absorbent properties of the tissue product. In one embodiment, a three-ply tissue product has two exterior hydrophobic plies each having a plurality of apertures extending from the surface of both exterior plies through the plies to a hydrophilic interior ply.

24 Claims, 4 Drawing Sheets

APERTURED TISSUE PRODUCTS

BACKGROUND

Formulations containing polysiloxanes have been topically applied to tissue products in order to increase the softness of the product. In particular, adding silicone compositions to a facial tissue can impart improved softness to the tissue while maintaining the tissue's strength. For example, polysiloxane treated tissues are described in U.S. Pat. Nos. 4,950,545; 5,227,242; 5,558,873; 6,054,020; 6,231,719 and 6,432,270. A variety of substituted and non-substituted polysiloxanes can be used.

While polysiloxanes are exceptionally good at improving softness, there can be disadvantages in their use. Polysiloxanes are generally hydrophobic meaning they tend to repel water. Tissue products treated with polysiloxane can be less absorbent than tissue products not containing polysiloxane. The tissue's absorbency can be further reduced by using amino-functional polysiloxanes, which tend to be more hydrophobic in nature. Increased hydrophobicity in a paper product, such as a tissue, can adversely impact the ability of the paper product to absorb liquids. Hydrophobic agents can also prevent bath tissue from becoming quickly saturated and disintegrating or dispersing when disposed of in a toilet creating problems when flushing the tissue.

Increasing the hydrophobicity of a paper product can provide various advantages. By making tissue paper hydrophobic, the fluid strike-through properties of the tissue can be improved. For example, fluids absorbed by the tissue can remain within the interior of the tissue paper and not be transferred through to the other side to wet a person's hands while using the tissue. Other methods to increase the barrier properties of tissue, such as adding sizing agents to the tissue product, can be used.

In order to increase the tissue absorbency, the hydrophobic additives can be topically applied in discrete locations on a tissue product leaving relatively large untreated areas of the product such that less than about 50 percent of the surface of the product is covered with the additive. The discrete placement of the additive on the tissue product can provide regions of hydrophobicity and hydrophilicity. The discrete placement may require a majority of the tissue's surface to not contain the additive. As a result, reduced product benefits, such as softness, are realized relative to a product having a high level of surface coverage. In addition to reduced softness benefits, such products may not achieve the desirable balance of rapid initial intake and increased strike through time. U.S. patent application Ser. No. 10/289,557, entitled Soft Tissue Hydrophilic Tissue Products Containing Polysiloxane and Having Unique Absorbent Properties, filed on Nov. 6, 2002, and herein incorporated by reference, describes the application of a surfactant in a patterned arrangement to enhance the absorbent properties of a hydrophobic tissue product to balance the strikethrough and absorbent rate.

As seen, there is an ongoing need to develop tissue products that have good hand protection properties yet meet the criteria for absorbency generally demanded in dry tissue products. There is also a need to manufacture these products with technologies currently available and that introduce a minimum incremental cost to the product.

SUMMARY

It has now been found that the fluid intake rate of a tissue product having at least one hydrophobic exterior layer can be significantly increased by the addition of apertures through the hydrophobic exterior layer to the tissue product's hydrophilic interior layer. The apertures allow for fluid to be absorbed by the hydrophilic interior layer, while leaving the hydrophobic exterior layer dry to the touch. The size, number and spacing of the apertures can be controlled to manage the absorbent properties of the tissue product In one aspect, the invention resides in a soft, thin, flexible absorbent tissue or wiping product having rapid fluid intake yet having delayed moisture penetration. In another aspect, the invention resides in a soft, thin, flexible absorbent tissue or wiping product structure comprising two hydrophobic apertured exterior layers and a hydrophilic interior layer. In still another aspect, the invention resides in a thin, flexible multi-ply tissue product or wiping product comprising three or more plies wherein the two outer plies comprise apertured hydrophobic layers that are adjacent to an inner ply or plies that are hydrophilic. In another aspect, the invention resides in a soft, thin, flexible absorbent tissue or wiping product comprising two polysiloxane treated hydrophobic apertured exterior layers and a hydrophilic interior layer. In still another aspect, the product is comprised of primarily cellulosic based fibers.

BRIEF DESCRIPTION OF THE DRAWINGS

The above aspects and other features, aspects, and advantages of the present invention will become better understood with regard to the following description, appended claims, and accompanying drawings in which:

Figure 1:
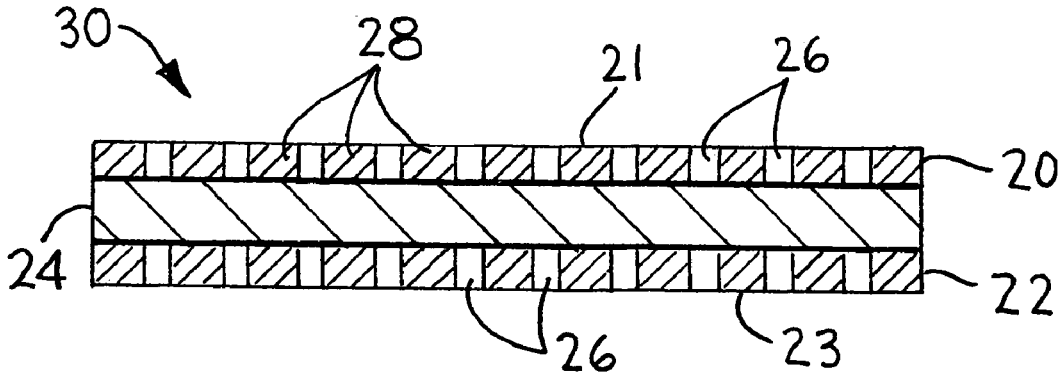
FIG. 1 illustrates a three-ply tissue product.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "hydrophobic layer" means that the tissue layer repels water. A "layer" as used herein can be one or more layers of a multi-layer single-ply tissue product, an entire ply of a multi-ply tissue product, or one or more layers of any ply within a multi-ply tissue product. The hydrophobicity of the layer can be determined by the contact angle of a drop of water placed on the hydrophobic layer. One suitable test for measuring the contact angle is ASTM D5725-99 Standard Test Method for Surface Wettability and Absorbency of Sheeted Materials Using an Automated Contact Angle Tester. The hydrophobic layers of the present invention will exhibit contact angles of about 80 degrees or greater, more specifically about 85 degrees or greater, and still more specifically about 88 degrees or greater. Due to the absorbent nature of tissue products, it may be difficult to measure the contact angle of the hydrophobic layer. For example, the apertures through the tissue layer can impede measurement of the contact angle. As such, measurement of the contact angle may need to be performed on identical tissue layers without the apertures. The specific degree of hydrophobicity of the layer can vary as long as the product has a high rate of fluid intake while having a low tendency for strikethrough or fluid migration from one side of the product to the other side.

As used herein, "hydrophilic layer" is any layer that is not a hydrophobic layer.

As used herein, "strikethrough" refers to the time it takes for a liquid to pass from one side of a tissue to the other side. Strikethrough can be measured using the Hercules Size Test as described in the Test Methods section.

As used herein, "tissue" refers to a substrate having one or more plies for wiping solid surfaces and human skin or hair containing primarily cellulosic fibers which comprise at least a majority of the fibers present. The tissue of the present invention can comprise between about 80 percent to about 100 percent by weight of cellulosic fibers, more specifically between about 85 percent to about 100 percent by weight cellulosic fibers, and still more specifically between about 90 percent to about 100 percent by weight of cellulosic fibers based on the total dry weight of the web such as between about 95 percent by weight to about 99.8 percent by weight of cellulosic fibers based on the total dry weight of the tissue sheet. Tissue sheets are a relatively thin substrate having a low density that are considered macroscopically planar even though embossing may introduce Z direction height variations within the tissue sheet.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Tissue products can be differentiated from other paper products in terms of their bulk. The bulk of the tissue products of the present invention may be calculated as the quotient of the caliper (as tested defined herein later), expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue products of the present invention which tend to have much higher calipers for a given basis weight. The tissue products of the present invention have a bulk that can range between about 2 $cm^3/g$ to about 20 $cm^3/g$, more specifically between about 3 $cm^3/g$ to about 20 $cm^3/g$, and still more specifically between about 4 $cm^3/g$ to about 18 $cm^3/g$.

The tissue products of the present invention can be made by any suitable manufacturing process. For example, suitable processes could include creped wet-pressed tissue, through air dried (TAD) tissue, uncreped through air dried (UCTAD) tissue, air laid tissue, or hydroentangled cellulosic products can be used. By being comprised of primarily cellulosic fibers, the tissue products of the present invention are more amenable to broke repulping operations.

Broke repulping refers to a process used in the production of tissue and paper products. During the production of tissue and paper products, significant amounts of scrap material can be accumulated. This waste product, also known as broke, is generated from products that do not fall within manufacturer's specifications or from excess tissue remaining after the finished product is completed. Since broke is essentially unused raw material, a process to recycle it for future use eliminates the inefficient disposal of a valuable source of papermaking fibers. High amounts of non-cellulosic solid materials, such as thermoplastic resins, synthetic fibers, non cellulosic films, and the like significantly impair the ability of the waste material to be reused in the tissue or paper process and hence increase the overall cost of manufacture of the product. Hence, there is an advantage to products comprising primarily cellulosic fibers.

A wide variety of natural and synthetic cellulosic fibers are suitable for use in the tissue products, plies and layers of the present invention. The pulp fibers may include fibers formed by a variety of pulping processes, such as kraft pulp, sulfite pulp, thermomechanical pulp, etc. In addition, the pulp fibers may consist of any high-average fiber length pulp, low-average fiber length pulp, or mixtures of the same.

An example of suitable high-average length cellulosic pulp fibers includes softwood fibers. Softwood pulp fibers are derived from coniferous trees and include pulp fibers such as, but not limited to, northern softwood, southern softwood, redwood, red cedar, hemlock, pine (e.g., southern pines), spruce (e.g., black spruce), combinations thereof, and the like. Northern softwood kraft pulp fibers may be used in the present invention. One example of commercially available northern softwood kraft pulp fibers suitable for use in the present invention include those available from Kimberly-Clark Corporation located in Neenah, Wis. under the trade designation of "Longlac-19".

Another example of suitable low-average length cellulosic pulp fibers are the so called hardwood pulp fibers. Hardwood pulp fibers are derived from deciduous trees and include pulp fibers such as, but not limited to, eucalyptus, maple, birch, aspen, and the like. In certain instances, eucalyptus pulp fibers may be particularly desired to increase the softness of the tissue sheet. Eucalyptus pulp fibers may also enhance the brightness, increase the opacity, and change the pore structure of the tissue sheet to increase its wicking ability. Moreover, if desired, secondary cellulosic pulp fibers obtained from recycled materials may be used, such as fiber pulp from sources such as, for example, newsprint, reclaimed paperboard, and office waste.

Examples of other synthetic and natural cellulosic fibers that may be used in the products of the present invention include, but are not limited to, cotton, rayon, lyocel and the like.

Referring now to FIG. 1, a multi-ply tissue product 30 is illustrated. The multi-ply tissue product has three distinct plies, including an upper hydrophobic exterior layer 20, a lower hydrophobic exterior layer 22, and a hydrophilic interior layer 24. In this instance, the layers comprise individual plies where the entire ply is either hydrophobic or hydrophilic.

The hydrophilic interior layer 24 of the three-ply product can be a low density, high bulk material. The bulk of layer 24 can range between about 2 $cm^3/g$ to about 20 $cm^3/g$, more specifically between about 3 $cm^3/g$ to about 20 $cm^3/g$, and still more specifically between about 4 $cm^3/g$ to about 18 $cm^3/g$. The hydrophilic interior layer 24 can have a specific absorbent capacity expressed as grams of water absorbed per gram of fiber of about 5 g/g or greater, about 7 g/g or greater, between about 6 g/g to about 18 g/g, or between about 7 g/g to about 16 g/g. In one embodiment, the hydrophilic interior layer 24 can be a resilient, TAD tissue product optionally containing a wet strength resin. The wet resilient TAD tissue can be calendered. When wetted after migration of fluid, the wet resilient TAD tissue can expand, providing additional absorbent capacity. This can help in keeping water away from the exterior surfaces of the tissue product and prevent strike through or wet through from one side of the product to the other.

The upper and lower hydrophobic exterior layers (20, 22) contain a plurality of apertures 26 extending from an upper exterior surface 21 and a lower exterior surface 23 through both outer plies such that fluids applied to the outer plies migrate through the apertures into the hydrophilic interior layer 24. Because the outer plies are hydrophobic and have lower free surface energy than the inner ply, there is little tendency for the fluid to wet out the non-apertured regions 28 of the outer plies keeping hands dry yet absorbing significant quantities of fluid in a very short period of time.

The hydrophobic exterior layers (20, 22) have apertures or holes extending from the exterior surfaces (21, 23) that are in fluid communication with the hydrophilic interior layer 24, such as extending through at least the thickness of the hydrophobic layer or ply. For example, the entire outer ply does not need to be hydrophobic. The outer surface layer can be hydrophobic and the apertures can extend only through the hydrophobic layer but not the entire ply to the adjacent hydrophilic interior layer within the same ply. In another embodiment, the apertures can extend through the entire ply regardless of whether the hydrophobic exterior surface layer comprises the entire ply or just a layer of the ply.

The apertures 26 can be dimensioned such that water or other fluids cannot pass directly through the layer or ply when not in contact with another absorbent layer or ply. Without wishing to be bound by theory, depending on the size of the apertures, it is believed that when the upper and lower hydrophobic layers (20, 22) are removed and a drop of water is placed on the exterior surface of the hydrophobic layer, the drop of water will stay on the surface and will not pass through the apertures to the other side. The surface tension of the water creates a meniscus at the aperture opening. Because there is sufficient surface tension present in the fluid, the fluid does not drip through the apertures and instead remains on the surface. However, when the upper and lower hydrophobic layers (20, 22) come into contact with the hydrophilic interior layer 24, the fluid in the meniscus region of the aperture can contact the hydrophilic interior layer, wicking fluid into that layer. Capillary forces draw the water from the surfaces of the outer plies through the apertures and into the hydrophilic interior layer. Once the moisture is absorbed into the hydrophilic layer, the water or fluid has limited tendency to move from the hydrophilic layer through the apertures towards the oppositely facing hydrophobic exterior layer. The capillary action tends to move fluids from the exterior surfaces through the apertures into the absorbent hydrophilic layer while restricting flow in the opposite direction. Therefore, absorbent structures can be developed that keep hands well protected, yet have excellent absorption properties both from an absorbent intake rate and an absorbent capacity.

In the tissue products, the hydrophobic layer or ply(s) can have a Wet Out Time (WOT) of between about 45 seconds or greater, about 60 seconds or greater, about 90 seconds or greater, or about 120 seconds or greater to about 600 seconds. While the WOT of the hydrophobic plies can be quite high, the intake rate of the fluid into the center ply is very rapid, owing to the presence of the apertures in the outer plies. This intake rate can be measured by the Automatic Gravimetric Absorbency Test (AGAT). AGAT is a test that generally measures the initial absorbency of a tissue product. The apparatus and test are well known in the art and are described in U.S. Pat. No. 4,357,827, herein incorporated by reference. The AGAT values of the entire multi-ply tissue product can be between about 0.7 seconds or greater, about 0.9 seconds or greater, or about 1.1 seconds or greater to about 5 seconds.

Alternatively, the Water Drop Test may be used to determine intake rate. The Water Drop Time, as defined in the Test Methods section, of the entire tissue product can be between about 0 seconds to about 10 seconds, between about 0 seconds to about 7 seconds, or between about 0 seconds to about 4 seconds.

The absorbency of the hydrophilic interior layer 24 can be measured by the Wet Out Area Test. The Wet Out Area Test, as defined in the Test Methods section, refers to the area of the absorbent layer that is wetted out prior to complete wet through of the tissue product. The test is described in U.S. Pat. No. 6,054,020, which is herein incorporated by reference. The tissue products of the present invention can have a Wet Out Area of about 2 square inches or greater. More specifically, the Wet Out Area can be between about 3 square inches or greater, more specifically about 4 square inches or greater, to about 8 square inches after 20 seconds or less. The Wet Through Time as measured by the Wet Out Area Test can be between about 20 seconds or greater, about 30 seconds or greater, about 45 seconds or greater to about 60 seconds.

The size and frequency of the apertures across the hydrophobic layer or ply can be varied to meet specific product attributes. If the apertures are too large, water can pass back through to the wetted surface or completely through the tissue product to the other side. If the apertures are too small or insufficient in frequency across the surface of the tissue product, fluids will be absorbed with insufficient speed to make the product useful as an absorbent tissue. When the tissue product is used as a wiping implement, the increased hydraulic pressure applied by the process of wiping can increase the likelihood that fluids will penetrate the apertures and be absorbed by the hydrophilic layer. Thus, fewer and smaller apertures can be used. Less apertures of a smaller size can leave the appearance of the tissue product visually indiscernible from a non-apertured tissue product. The appearance of too many apertures or apertures too large in size can result in a negative consumer perception the tissue product is inappropriate for specific tasks ordinarily performed by non-apertured tissue products. For example, tissue products intended for nose care instead of surface cleaning and wiping.

The size and number of apertures in the hydrophobic layer is not overly critical to the invention so long as the fluid intake and strikethrough requirements are met. In general, the apertures will be present at a frequency of from about 3 apertures per lineal inch to about 800 apertures per lineal inch, such as from about 5 apertures per lineal inch to about 600 apertures per lineal inch, and still more specifically from about 10 apertures per lineal inch to about 400 apertures per lineal inch when measured in any direction of the sheet. The angle of the line used to measure the spacing of the apertures on the product should be selected to give the maximum number of apertures possible. The area of the apertures can range between about 0.0001 $mm^2$ to about 8 $mm^2$, more specifically between about 0.0004 $mm^2$ to about 5 $mm^2$, and still more specifically between about 0.0008 $mm^2$ to about 3 $mm^2$.

The apertures may be aligned with the apertures on the opposite side of the product, may be offset from the apertures on the opposite side of the product or may be randomly offset and aligned with the apertures on the opposite side of the product. In a specific embodiment, the apertures on one side of the product are completely offset from the apertures on the opposite side of the product. Offsetting of the apertures is advantageous in minimizing backflow wherein the moisture in the product is expressed through the apertures on the opposite side of the product via pressure applied to one surface of the product. Offsetting of the apertures may also be advantageous in maintaining tensile strength properties of the product and in reducing formation of weakness zones where the product may rip or tear.

Figure 2:
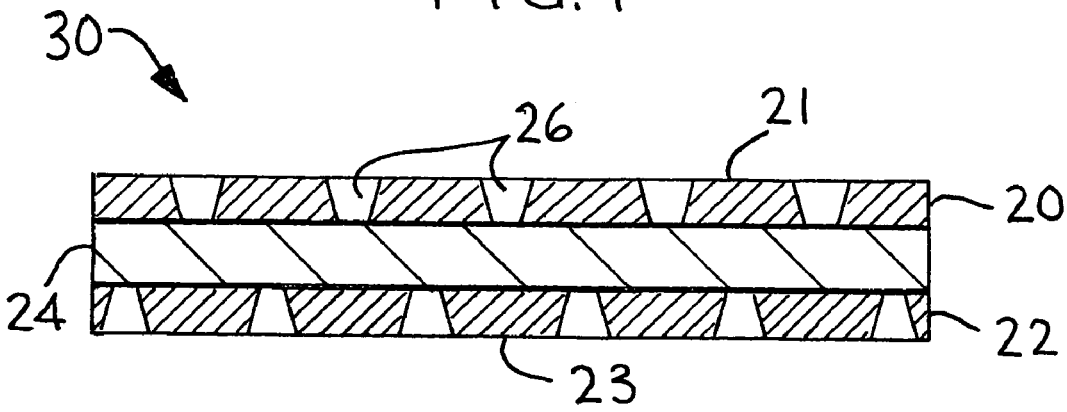
FIG. 2 illustrates a three-ply tissue product.

Referring now to FIG. 2, the apertures 26 may also have a three-dimensional shape wherein the size of the aperture varies as it extends from the hydrophobic layer (20, 22) to the hydrophilic layer 24. In one embodiment, the apertures can be tapered such that the size of the aperture at the exterior surface of the hydrophobic layer is greater than the size of the aperture where it contacts the hydrophilic layer. In another embodiment, the apertures can be oppositely tapered such that the size of the aperture at the exterior surface of the hydrophobic layer is smaller than the size of the aperture where it contacts the hydrophilic layer. Preferably, the size of the aperture is the same or greater at the exterior surface (21, 23) of the hydrophilic layer than the size of the aperture where it contacts the hydrophilic layer. Variations of the aperture's taper can help facilitate the liquid flow into the hydrophilic layer(s) and minimize wetting through to the opposite side or surface.

The apertures through the hydrophobic layer or ply can be made by a variety of methods. Perforated embossing of the layer can be used such that during embossing, penetration of layer is achieved thereby creating a physical puncture through the hydrophobic layer. The perforated embossing can be done either on the individual layers or plies, or on the entire multi-ply tissue product. Other methods to form the apertures include: pin aperturing, die punching, die stamping, water knives that cut out the desired holes in the web, vacuum assisted aperturing whereby a high vacuum is applied to one side of the wet web as it is supported by a porous surface, laser cutters, needle punching and the like. In another embodiment, the apertures may be made on the tissue machine such as described in U.S. Pat. No. 3,881,987, entitled Method for Forming Apertured Fibrous Webs that issued to Benz on May 6, 1975.

Figure 3:
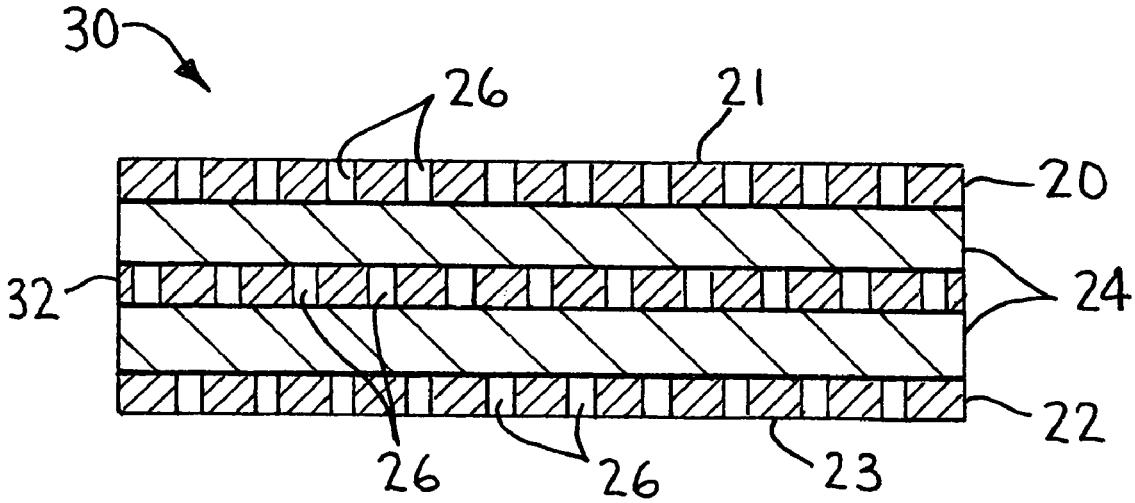
FIG. 3 illustrates a five-ply tissue product.

Referring now to FIG. 3, another multi-ply tissue product 30 having five distinct plies is illustrated. In the illustrated embodiment, the upper and lower hydrophobic exterior layers (20, 22) comprise hydrophobic plies that are apertured. Adjacent each outer ply is a hydrophilic interior layer 24 that comprises a hydrophilic ply. Between the two hydrophilic interior layers is a hydrophobic interior layer 32. The hydrophobic interior layer comprises another hydrophobic ply having a plurality of apertures 26 extending through the hydrophobic interior ply. Such a tissue product may be useful for applications where a higher absorbent capacity and significantly longer strikethrough times are required.

Figure 4:
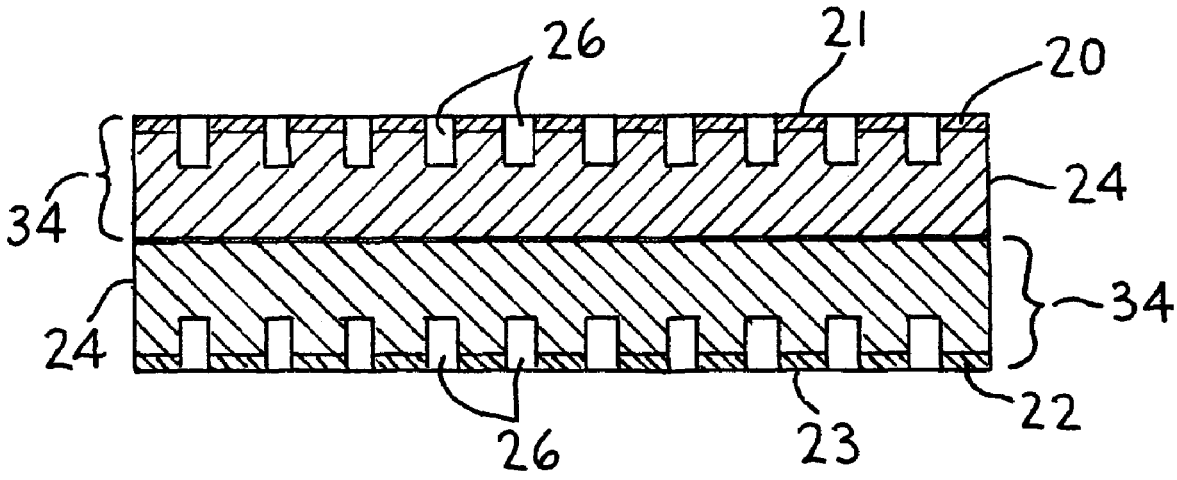
FIG. 4 illustrates a two-ply tissue product.
Figure 5:
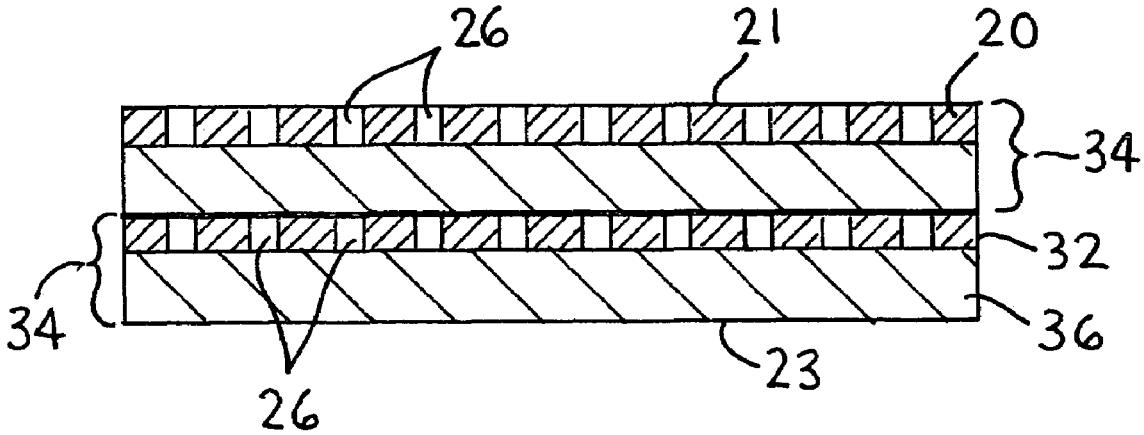
FIG. 5 illustrates a two-ply tissue product.
Figure 6:
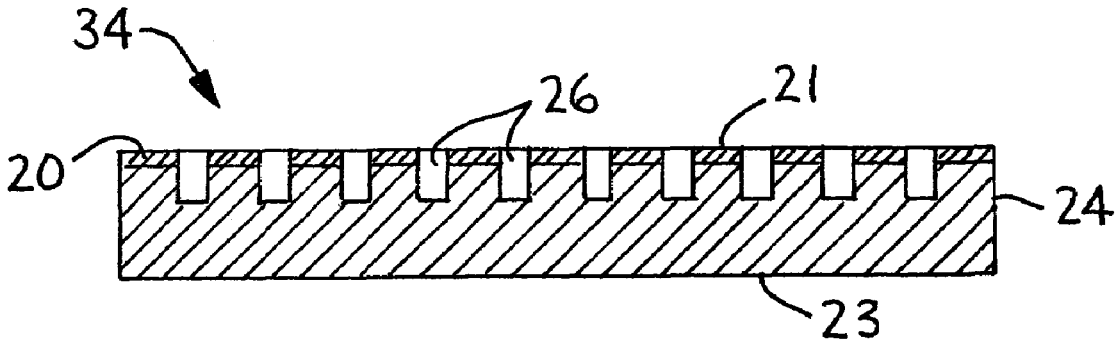
FIG. 6 illustrates a single-ply product.

Additional multi-ply embodiments can be designed. For example, FIGS. 4 and 5 illustrate two-ply embodiments. Referring to FIG. 4, a two-ply embodiment using two layered tissue plies is illustrated. The layered single-ply tissue product 34 forming each ply is illustrated in FIG. 6 and discussed herein later. Two layered single-ply tissue products 34 are placed in a face-to-face relationship such that the apertured hydrophobic layers form the upper and lower exterior layers (21 and 23) of the two-ply tissue product. In this embodiment, the hydrophobic layer forms only a portion of the thickness of each ply, and an interior hydrophilic layer 24 forms the remaining portion of each ply.

The apertures 26 may extend only through the thickness of the hydrophobic layer, through the thickness of the hydrophobic layer and into the hydrophilic layer, through the entire thickness of each ply, or through the entire thickness of the two-ply product. The apertures may be offset or aligned with the apertures on the opposing surface. Preferably, the apertures do not extend through the entire thickness of the two-ply product. In one embodiment, the apertures extend only through the depth of the hydrophobic layer of each ply. The apertures may be introduced either prior to or after the plying step producing the two-ply product.

An alternative two-ply embodiment is illustrated in FIG. 5. Two layered single-ply tissue products 34 are placed in a face-to-face relationship such that one of the apertured hydrophobic layers forms an upper hydrophobic exterior layer 20 while the other side of the tissue product comprises a hydrophilic exterior layer 36. The other hydrophobic layer of one ply forms a hydrophobic interior ply 32 having a plurality of apertures 26. In this embodiment, the hydrophobic layer forms only a portion of the thickness of each ply, and a hydrophilic layer forms the remaining portion of each ply.

The apertures 26 may extend only through the thickness of the hydrophobic layer, through the thickness of the hydrophobic layer and into the hydrophilic layer, through the entire thickness of each ply, or through the entire thickness of the two-ply product. The apertures may be offset or aligned with the apertures on the opposing surface. Preferably, the apertures do not extend through the entire thickness of the two-ply product. In one embodiment, the apertures extend only through the depth of the hydrophobic layer of each ply. The apertures may be introduced either prior to or after the plying step producing the two-ply product.

Possible applications for this multi-ply tissue product could be a tissue product where one side acts as a delay membrane when contacting liquid. Water contacting the apertured hydrophobic exterior layer side would slowly migrate to the other ply's hydrophilic exterior surface. A water reactive component could be added to the hydrophilic exterior layer 36 or placed adjacent to its surface. Water passage to layer 36 could be delayed, and then reacts with the reactive component to produce the desired effect.

In an alternative, instead of using two plies of a layered single-ply tissue product, the multi-ply tissue products of FIGS. 4 and 5 can be made from four separate plies having the desired hydrophobic or hydrophilic property. In the various multi-ply tissue products of the invention, the apertured hydrophobic layer or ply is adjacent to at least one hydrophilic layer or ply. By adjusting the number of layers or plies and the hydrophobic or hydrophilic properties of the layers or plies, it is possible to tailor specific product properties such as intake rate, absorbency, and strikethrough as desired for the tissue product's moisture management.

Referring now to FIG. 6, a single-ply embodiment is illustrated. The single-ply tissue product 34 has been manufactured to form an upper hydrophobic exterior layer 20 on one of the tissue's surfaces adjacent the hydrophilic interior layer 24. The hydrophobic layer can be created by making a layered single-ply tissue web as known in the art and using polysiloxane treated pulp for the hydrophobic layer as described in U.S. Pat. No. 6,582,560, entitled Method for Using Water Insoluble Chemical Additives With Pulp and Products Made by said Method that issued on Jun. 24, 2003, to Runge, et. al. and which is herein incorporated by reference. Alternatively, the hydrophobic layer can be made by adding an appropriate hydrophobic chemical to one of the stock streams forming one of the exterior layers, or chemically treating a blended or layered tissue product by adding a hydrophobic chemical to one of the exterior surfaces. For example, hydrophobic film forming compositions can be used to form the hydrophobic layer and the compositions may be maintained primarily on the exterior surfaces of the tissue product with minimum z-direction penetration. Tissue machines having the capability to produce layered webs having good layer purity are useful for making the single-ply embodiment. Use of fibers pretreated with a hydrophobic additive may be advantageous over creating the hydrophobic layer after forming and drying the web where it can be harder to control migration of the hydrophobic additive within the single-ply tissue product.

The upper hydrophobic exterior layer 20 occupies only a portion of the single-ply tissue product's total thickness. In various embodiments, the thickness of the upper hydrophobic exterior layer can comprise about 40 percent or less of the ply's thickness, about 30 percent or less of the ply's thickness, about 20 percent or less of the ply's thickness, between about 5 percent to about 40 percent of the ply's total thickness, or between about 10 percent to about 30 percent of the ply's total thickness. The thickness of the upper hydrophobic exterior layer is controlled to ensure adequate absorbent capacity remains in the single-ply tissue. The remaining portion of the single-ply tissue product comprises the hydrophilic interior layer 24, which is substantially or entirely free of the hydrophobic additive.

A plurality of apertures 26 extend from the surface of the upper hydrophobic exterior layer in fluid communication with the hydrophilic layer such as through at least the depth of the hydrophobic layer to the hydrophilic interior layer 24. The apertures may penetrate the entire thickness of the single-ply tissue product; however, in a preferred embodiment, the apertures do not penetrate the entire thickness of the single-ply tissue product. The apertures can extend partially into the hydrophilic interior layer without extending completely through the single-ply tissue product or the apertures can end at approximately the interface between the hydrophobic and hydrophilic layer. The single-ply tissue product of FIG. 6 can be plied together with other single or multi-ply webs to form a multi-ply tissue product. For example, the multi-ply tissue products illustrated in FIGS. 4 and 5.

Figure 7:
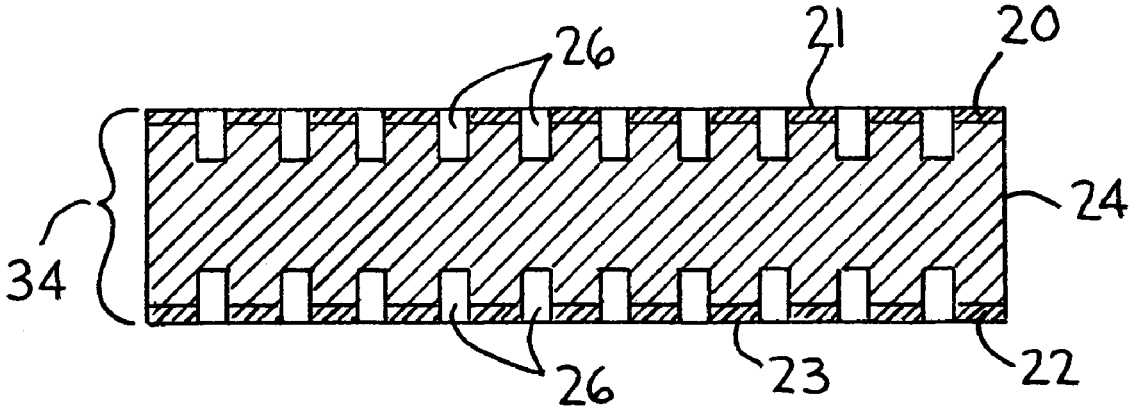
FIG. 7 illustrates a single-ply tissue product.

Referring now to FIG. 7, another single-ply tissue product is illustrated. The single-ply tissue product 34 has been manufactured such that upper and lower hydrophobic exterior layers (20, 22) comprise the upper and lower exterior surfaces (21, 23). The middle portion of the single-ply tissue product comprises the interior hydrophilic layer 24. The hydrophobic layers can be created by making a layered single-ply tissue web as known in the art using polysiloxane treated pulp for the outer layers, adding an appropriate hydrophobic chemical to the stock streams feeding the outer layers of the layered headbox, or chemically treating a blended tissue or layered product by adding a hydrophobic chemical to both of the exterior surfaces. For example, hydrophobic film forming compositions can be used to form the hydrophobic layer and the compositions may be maintained primarily on the exterior surfaces of the tissue product with minimum z-direction penetration. Tissue machines having the capability to produce layered webs having good layer purity are useful for making the single-ply embodiment. Use of fibers pretreated with a hydrophobic additive may be advantageous over creating the hydrophobic layer after forming and drying the web where it can be harder to control migration of the hydrophobic additive within the single-ply tissue product.

The upper and lower hydrophobic layers (20, 22) occupy only a portion of the single-ply's total thickness. In various embodiments, the thickness of each of the hydrophobic layers can comprise about 30 percent or less of the ply's thickness, about 20 percent or less of the ply's thickness, about 10 percent or less of the ply's thickness, between about 5 percent to about 30 percent of the ply's total thickness, or between about 5 percent to about 25 percent of the ply's total thickness. The thicknesses of the hydrophobic layers are controlled to ensure that adequate absorbent capacity remains in the single-ply tissue. The remaining portion of the single-ply tissue product comprises the hydrophilic interior layer 24, which is substantially or entirely free of the hydrophobic additive.

A plurality of apertures 26 extends from the surfaces of the upper and lower hydrophobic exterior layers in fluid communication with the hydrophilic interior layer such as through at least the depth of the hydrophobic layers to the hydrophilic interior layer 24. The apertures may penetrate the entire thickness of the single-ply tissue product; however, in a preferred embodiment, the apertures do not penetrate the entire thickness of the single-ply tissue product. The apertures can extend partially into the hydrophilic interior layer without extending completely through the single-ply tissue product or the apertures can end at approximately the interface between the hydrophobic and hydrophilic layer.

Single-ply tissue products having two hydrophobic exterior surface layers can have higher basis weights and calipers than the single-ply embodiment illustrated in FIG. 6, although this is not necessary. The single-ply tissue product can be plied together with other single- or multi-ply webs to form multi-ply tissue products. The single-ply tissue product illustrated in FIG. 7 is useful for applications where delamination of the individual plies within a multi-ply tissue product may occur due to its intended use or for more economical tissue products where higher absorbent capacities are not required.

Figure 8:
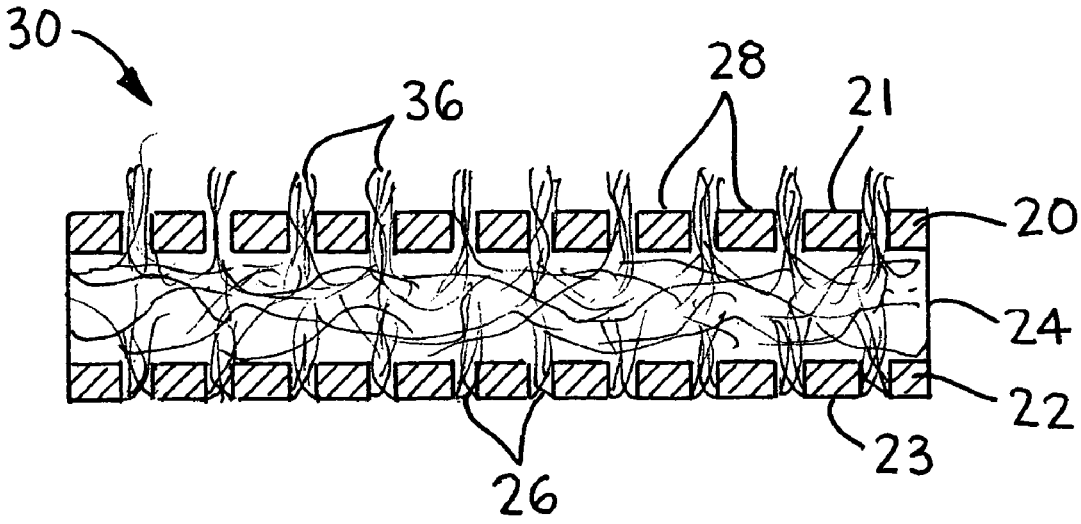
FIG. 8 illustrates a three-ply tissue product.

Referring now to FIG. 8, another multi-ply tissue product is illustrated. The multi-ply tissue product 30 comprises an upper and a lower hydrophobic exterior layer or ply (20, 22) having a plurality of apertures 26 and an interior hydrophilic layer or ply 24. In the illustrated embodiment, the hydrophobic layers comprise the two outer plies and the hydrophilic layer comprises the middle ply of the multi-ply tissue product. Alternately, the hydrophobic layers could comprise only a layer of the exterior plies. Contained within the apertures 26 are hydrophilic fibers 36 extending from the hydrophilic interior layer 24 that are pulled into the apertures. The hydrophilic fibers 36 can provide a conduit for fluids to travel rapidly into the hydrophilic interior layer of the tissue product.

As shown in FIG. 8, the hydrophilic fibers 36 from the interior hydrophilic layer or ply are contained in the apertures located in hydrophobic layers or plies. The hydrophilic fibers 36 may be below, even with, or above the surface of the exterior hydrophobic layer. In the illustrated embodiment, the hydrophilic fibers 36 extend above the upper exterior surface 21 and are even with the lower exterior surface 23. Needling techniques similar to the carding process can be used to manipulate fibers into the apertures.

Alternatively, needles having hooks or materials having small hooks, such as the hook material of hook and loop fasteners, can be used to pull fibers into the apertures upon withdrawal while also creating the apertures as the hooks or needles are pushed into the tissue product. The fibers can be trimmed to be even with the exterior surface if desired.

In the various single-ply or multi-ply tissue products of the invention, each ply is relatively thin. The thinner caliper ensures that the single- or multi-ply tissue products will have sufficient drape and flexibility to act as a wipe. Other products that may have apertured layers, such as diapers or sanitary napkins, are generally unsuited for use as a wiper or a cleaning sheet owing to their much greater stiffness and much greater thicknesses. The caliper for each ply can be between about 0 microns to about 500 microns or less, such as about 400 microns or less, about 300 microns or less, or about 90 microns or less. Preferably, the multi-ply tissue products of the present invention have a total caliper for all plies of about 600 microns or less, about 500 microns or less, or about 400 microns or less.

"Caliper", as used herein, is the thickness of a single ply or of the multi-ply product and can either be measured as the thickness of a single sheet or as the thickness of a stack of ten sheets and dividing the ten sheet thickness by ten, where each sheet within the stack is placed with the same side up. Caliper is expressed in microns. It is measured in accordance with TAPPI test methods T402 'Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked sheets. The micrometer used for carrying out T411 om-89 is a Bulk Micrometer (TMI Model 49-72-00, Amityville, N.Y.) or equivalent, having an anvil diameter of 4 1/16 inches (103.2 millimeters) and an anvil pressure of 220 grams/square inch (3.3 kilo Pascals).

In a specific embodiment of the multi-ply tissue product, it may be advantageous to use plies having different calipers with the hydrophobic apertured outer ply or plies having a lower caliper than the hydrophilic inner ply or plies. The necessary absorbent capacity can be provided by the thicker hydrophilic ply while the desired prevention of fluid strikethrough can be provided by the thinner apertured hydrophobic plies.

The bone dry basis weight of the tissue products can range between about 8 g/m$^2$ to about 120 g/m$^2$, more specifically between about 10 g/m$^2$ to about 100 g/m$^2$, and still more specifically between about 20 g/m$^2$ to about 80 g/m$^2$, such as between about 25 g/m$^2$ to about 60 g/m$^2$. The bone dry basis weight of any individual ply may range between about 4 g/m$^2$ to about 100 g/m$^2$, more specifically between about 6 g/m$^2$ to about 80 g/m$^2$ and still more specifically between about 8 g/m$^2$ to about 70 g/m$^2$.

For multi-ply products of the present invention, it may, at times, be advantageous to use different basis weights for the various plies. In a specific embodiment of a three-ply or three-layer product of the present invention, the basis weight of the hydrophilic interior layer is greater than the basis weight of the upper and lower hydrophobic exterior layers. In various embodiments the basis weight of the hydrophilic interior layer can be about 10 percent to about 500 percent greater than the basis weight of the hydrophobic exterior layers, or about 25 percent to about 300 percent greater than the basis weight of the hydrophobic exterior layers, or about 30 percent to about 200 percent greater than the basis weight of the hydrophobic exterior layers.

The tensile strength of the tissue products of the present invention can be adjusted such that the tensile strength is sufficient for the intended application. In general, the tissue products of the present invention will have a geometric mean tensile strength (GMT) between about 300 g/3" to about 3,000 g/3", or between about 500 g/3" to about 2,000 g/3", or between about 650 g/3" to about 1500 g/3". Since the process of aperturing the ply or layer may reduce the tensile strength of that ply or layer, it may be advantageous to use a higher strength ply or layer and then aperture that ply or layer such that the tensile strength per unit basis weight of the apertured hydrophobic ply or layer, after aperturing, approximates the tensile strength per unit basis weight of the hydrophilic center ply or layer.

The strikethrough resistance of the tissue product can be measured by the Hercules Size Test (HST). The tissue products of the present invention can have HST values between about 10 seconds or greater, about 15 seconds or greater, about 25 seconds or greater, about 35 seconds or greater to about 300 seconds.

The single-ply and multi-ply tissue products of the present invention are useful for facial, bath, napkins, and paper towel products. The tissue products may be useful in other applications where the specific attributes are essential to the product's function. For example, the tissue products may be used in health care settings to clean potential biohazard or other fluids, providing additional protection beyond gloves. The fluid trapped in the hydrophilic layer is less prone to drip through the tissue product and contaminate other areas. In a similar manner, the tissue products could find use in chemical laboratories and industrial settings for improved protection against contact with hazardous materials. In multi-ply tissue products, the interior plies could contain anti-viral agents or other ingredients to act on specific elements in the absorbed fluid, yet prevent the active agent from coming in contact with the user.

The chemistry for manufacturing the hydrophobic layers or entire hydrophobic plies can be done by any method known in the art. Hydrophobic layers or plies can be made by using sizing agents, polysiloxanes, hydrophobic acrylates, or any other material capable of imparting hydrophobicity to the product as known in the art. Specifically in one embodiment, the hydrophobicity may be created using standard cellulose sizing agents as described in U.S. Pat. No. 6,027,611, entitled Facial Tissue With Reduced Moisture Penetration, issued to McFarland et. al. and herein incorporated by reference. In still another embodiment, the hydrophobicity may be created using hydrophobic polysiloxanes. Such polysiloxanes are broadly known in the art. The polysiloxanes are useful also for imparting surface softness to the product. Specific polysiloxanes particularly suited to the present invention are amino functional polysiloxanes. Such polysiloxanes will generally have the following structure:

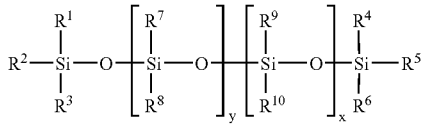

Wherein, x and y are integers >0. The mole ratio of x to (x+y) can be from about 0.005 percent to about 25 percent. The $R^1$-$R^9$ moieties can be independently any organofunctional group including $C_1$ or higher alkyl groups, ethers, polyesters, imines, amides, or other functional groups including the alkyl and alkenyl analogues of such groups.

The $R^{10}$ moiety is an amino functional moiety including but not limited to primary amine, secondary amine, tertiary amines, quaternary amines, unsubstituted amides and mixtures thereof. An exemplary $R^{10}$ moiety contains one amine group per constituent or two or more amine groups per substituent, separated by a linear or branched alkyl chain of $C^1$ or greater. In a specific embodiment, $R^7$ and $R^8$ are $C_1$ or higher alkyl groups or mixtures thereof. In another specific embodiment $R^7$ and $R^8$ are methyl. Suitable specific polysiloxanes for the present invention include: DC 2-8220 manufactured and sold by Dow Corning, Midland, Mich. and Y-14,344 manufactured and sold by GE/OSi Corporation. The hydrophobic additive may be applied at any concentration to render the ply or layer hydrophobic as defined. In particular, the polysiloxane concentration, if present, may be in the range of between about 0.2 percent by weight to about 5 percent by weight of total dry fiber in the tissue product, specifically from about 0.3 percent to about 4 percent by weight of total dry fiber, and more specifically from about 0.5 percent to about 2 percent by weight of dry fiber. It may also be advantageous to use a sizing agent to generate some of the hydrophobic properties in conjunction with the polysiloxane to minimize usage of expensive polysiloxanes.

EXAMPLES

Example 1

Two three-ply tissue products having an upper and a lower hydrophobic exterior layer and a hydrophilic interior layer were prepared in the following manner. The two hydrophobic exterior plies were prepared by pretreating cellulosic Eucalyptus fibers with a hydrophobic amino functional polysiloxane (DC 2-8220 from Dow Corning, Midland, Mich.) at a level of 2.5 percent by weight polysiloxane using the method described by Runge in U.S. Pat. No. 6,582,560. The hydrophobic wet pressed creped single-ply tissue product had a basis weight of about 12.5 g/m$^2$ and a single-ply caliper of 90 microns was prepared using the pretreated pulp fibers. The single-ply tissue product was a two-layer ply comprising 70 percent Eucalyptus silicone treated fibers as one layer and 30 percent NSWK pulp as the other layer. Total silicone content in the product was approximately 1.75 percent.

A single-ply hydrophilic interior ply was made from an uncreped through-air-dried single-ply hydrophilic tissue product having a bone dry basis weight of about 45 g/m$^2$ and a caliper of about 400 microns.

A three-ply tissue product having a total basis weight of about 60 g/m$^2$ was prepared using the hydrophobic wet pressed tissue as exterior plies with the inner uncreped through-air-dried tissue as the center ply. The exterior hydrophobic plies were oriented such that the layers containing the silicone treated pulp formed the exterior surfaces of the three-ply tissue product. The non-apertured three-ply product had a Water Drop Test time in excess of 3 minutes when tested.

Another three-ply tissue product was made by pin aperturing the hydrophobic exterior plies prior to placement adjacent the hydrophilic interior ply. The apertures had a diameter of about 0.5 mm and were spaced approximately 2 mm apart in both the X and Y directions. The three-ply tissue product had a total basis weight of about 60 g/m$^2$ using the apertured hydrophobic wet pressed tissue as exterior plies with the inner uncreped through-air-dried tissue as the center ply. The apertured exterior hydrophobic plies were oriented such that the layers containing the silicone treated pulp formed the exterior surfaces of the three-ply tissue product. The apertured tissue product had a Water Drop Test time of less than 1 second. A large area of the hydrophilic interior ply was wet and there was no wetting of the opposite apertured hydrophobic layer nor was there any penetration of the liquid to the surface below the tissue.

Example 2

Eucalyptus fibers were pulped for 30 minutes and placed in a holding chest. Likewise, a mixture of 72 percent Northern Softwood Kraft and 28 percent Northern Hardwood Kraft was pulped for 30 minutes and placed in a holding chest. The Northern Softwood/Northern Hardwood Kraft fiber and Eucalyptus fibers mixtures were then fed to individual stuffboxes and a commercially available wet strength chemical (Kymene 557LX, Hercules, Inc., Wilmington, Del.) was added in the amount of 0.82 lbs/ton of active solids per total product weight and a sizing agent (Precis 3000, commercially available from Hercules Incorporated) was added at a rate of 1.75 lbs/ton of active solids per total product weight.

The slurries were forwarded by a fan pup to a layered headbox to form a three-layered tissue product comprising 30 percent Eucalyptus fibers in each outer layer and 40 percent NSWK/NHWK fibers in the inner layer. The suspension is deposited from the multi-layer headbox onto an Appleton Mills 2164A forming fabric and Appleton Mills style 5611-AmFlex 2 S press felt and dewatered to about 12 percent consistency. The web was then transferred to the Yankee dryer via a vacuum pressure roll. The rubber covered vacuum pressure roll further dewaters the wet web to approximately 42 percent consistency through mechanical pressing against the Yankee dryer at 200 pli nip pressure with 5 inches vacuum pressure across the press felt.

The web was then dried on the steam heated Yankee dryer to a dry weight consistency greater than 96 percent. Prior to web removal from the dryer with a creping doctor blade, the web temperature reaches in excess of 180 degrees F. An aqueous mixture of an adhesive was continuously sprayed onto the Yankee dryer via a spray boom. The creped tissue was then wound onto a core running at a speed approximately 30 percent slower than the Yankee dryer. The three-layer single-ply tissue product is highly hydrophobic having a Wet Out Time in excess of 300 seconds. The contact angle was determined to be 90 degrees. The tissue product had a basis weight of 12.5 g/m$^2$ and a single-ply caliper of 90 microns.

Another creped single-ply tissue product having a basis weight of 12.5 g/m$^2$ was prepared as above with the exception that the sizing agent was not used. The three-layer hydrophilic single-ply tissue product had a single-ply caliper of 110 microns, a Specific Absorbent Capacity of about 9 g/g and a Wet Out Time of 3.4 seconds.

A three-ply tissue product was made from the single ply hydrophilic and hydrophobic tissue products. Apertures were created via a needle embossing process in the hydrophobic tissue plies. The apertures are approximately 0.5 mm in diameter and are spaced about 1.5 mm apart in the X and Y directions. The hydrophilic ply and two hydrophobic apertured plies were then plied together to form a three-ply tissue product with the two apertured hydrophobic plies forming the two exterior plies of the three-ply tissue product. The three-ply tissue product had a Water Drop Test value of 3.5 seconds, a Wet Out Area of 5 in$^2$ after 30 seconds (no wet through) and an HST value of 55 seconds.

TEST METHODS

Geometric Mean Tensile (GMT)

The Geometric Mean Tensile (GMT) strength test results are expressed as grams-force per 3 inches of sample width. GMT is computed from the peak load values of the MD (machine direction) and CD (cross-machine direction) tensile curves, which are obtained under laboratory conditions of 23.0° C.±1.0° C., 50.0±2.0% relative humidity, and after the tissue sheet has equilibrated to the testing conditions for a period of not less than four hours. Testing is conducted on a tensile testing machine maintaining a constant rate of elongation, and the width of each specimen tested was 3 inches. The "jaw span" or the distance between the jaws, sometimes referred to as gauge length, may range from about 2.0 inches (50.8 mm) to about 4.0 inches (100.6 mm). The crosshead speed is 10 inches per minute (254 mm/min.) A load cell or full-scale load is chosen so that all peak load results fall between 10 and 90 percent of the full-scale load. Such testing may be done on an Instron 1122 tensile frame connected to a Sintech data acquisition and control system utilizing IMAP software running on a "486 Class" personal computer or equivalent system. This data system records at least 20 load and elongation points per second. A total of 10 specimens per sample for each direction are tested. The average of the ten MD tensile values is determined and the average of the ten CD tensile values is determined. GMT is calculated using the average MD and the average CD tensile values from the following equation:

$$GMT=(MD\ \text{Tensile}*CD\ \text{Tensile})^{1/2}$$

Automatic Gravimetric Absorbency Test (AGAT)

The Automatic Gravimetric Absorbency Tester (AGAT) is a test that generally measures the initial absorbency of a tissue product. The apparatus and test are well known in the art and are described in U.S. Pat. No. 4,357,827, entitled Gravimetric Absorbency Tester that issued Nov. 9, 1982 to McConnell and which is incorporated herein by reference. For the purpose of the present invention, six tissue products (6 plies for a single-ply product, 12 plies for a two-ply product and 18 plies for a three-ply product) are tested together. All specimens were conditioned for at least 4 hours at 23+/−1° C. and 50+/−2 percent relative humidity prior to testing. During testing, the specimen is placed on a test cell that is in communication with a reservoir vessel. For three-ply products, six tissue products are tested together to form a test specimen. (Three plies per product, 18 plies total.) A valve is then opened so that liquid is free to flow from the vessel to the test cell. The sample being tested absorbs liquid from the reservoir vessel. The amount of liquid taken up by the test specimen is determined over a period of time. In particular, the AGAT machine generates an absorption curve from 2.25 seconds to as long as desired. The AGAT result is obtained by measuring the average slope from between 2.25 and 6.25 seconds. Ten test specimens are prepared for each tissue product tested and the average of the ten test specimens is reported as the tissue product's AGAT value.

Hercules Size Test

The Hercules Size Test (HST) is a test that generally measures how long it takes for a liquid to travel through a tissue product. Hercules size testing is done in general accordance with TAPPI method T 530 PM-89, *Size Test for Paper with Ink Resistance*. Hercules Size Test data was collected on a Model HST tester using white and green calibration tiles and the black disk provided by the manufacturer. A 2 percent Napthol Green N dye diluted with distilled water to 1 percent was used as the dye. All materials are available from Hercules, Inc., Wilmington, Del.

All specimens were conditioned for at least 4 hours at 23+/−1° C. and 50+/−2 percent relative humidity prior to testing. The test is sensitive to dye solution temperature so the dye solution should also be equilibrated to the controlled condition temperature for a minimum of 4 hours before testing. Six tissue products form a specimen for testing (18 plies for a three-ply tissue product, 6 plies for a single-ply product). Specimens are cut to an approximate dimension of 2.5×2.5 inches.

The instrument is standardized with the white and green calibration tiles per the manufacturer's directions. The specimen is then placed in the sample holder with the outer surface of the plies facing outward. The specimen is then clamped into the specimen holder. The specimen holder is then positioned in the retaining ring on top of the optical housing. Using the black disk the instrument zero is calibrated. The black disk is removed and 10+/−0.5 milliliters of dye solution is dispensed into the retaining ring and the timer started while placing the black disk back over the specimen. The test time in seconds is recorded from the instrument.

Water Drop Test

The Water Drop Test measures the intake rate of the tissue product. The Water Drop Test values are measured after first conditioning the tissue product at 23.0° C.±1.0° C. and 50.0 percent±2.0 percent relative humidity for a period of at least 4 hours. The conditioned test specimen is placed on a dry glass plate. The tissue product is tested as manufactured as a single- or multi-ply tissue product. A single drop (100 microliters, 0.1±0.01 ml.) of distilled water (23.0° C.±1.0° C.) is dispensed from an Eppendorf style pipette positioned slightly above the surface of the test specimen.

To determine the intake rate, the water drop should be positioned close to the center of the test specimen. The water drop is viewed by the naked eye on a plane horizontal to the surface of the test specimen. A stopwatch is started immediately after the water drop is dispensed onto the test specimen. The elapsed time for the water drop to be completely absorbed by the specimen, measured in seconds, is the Water Drop Test value for that specimen. The water drop is completely absorbed when it completely disappears, that is, there is no visible vertical element of the water drop remaining. If, after 3 minutes, the water drop is not completely absorbed, the test is stopped and the Water Drop Value is assigned a value of 180 seconds. Ten (10) water drops are randomly placed on the surface of the test specimen far enough apart such that the water is not absorbed by a previously wetted area. The test values for each drop are recorded and averaged. The average intake time in seconds is recorded as the Water Drop Test value.

Wet Through Time and Wet Out Area

Figure 9:
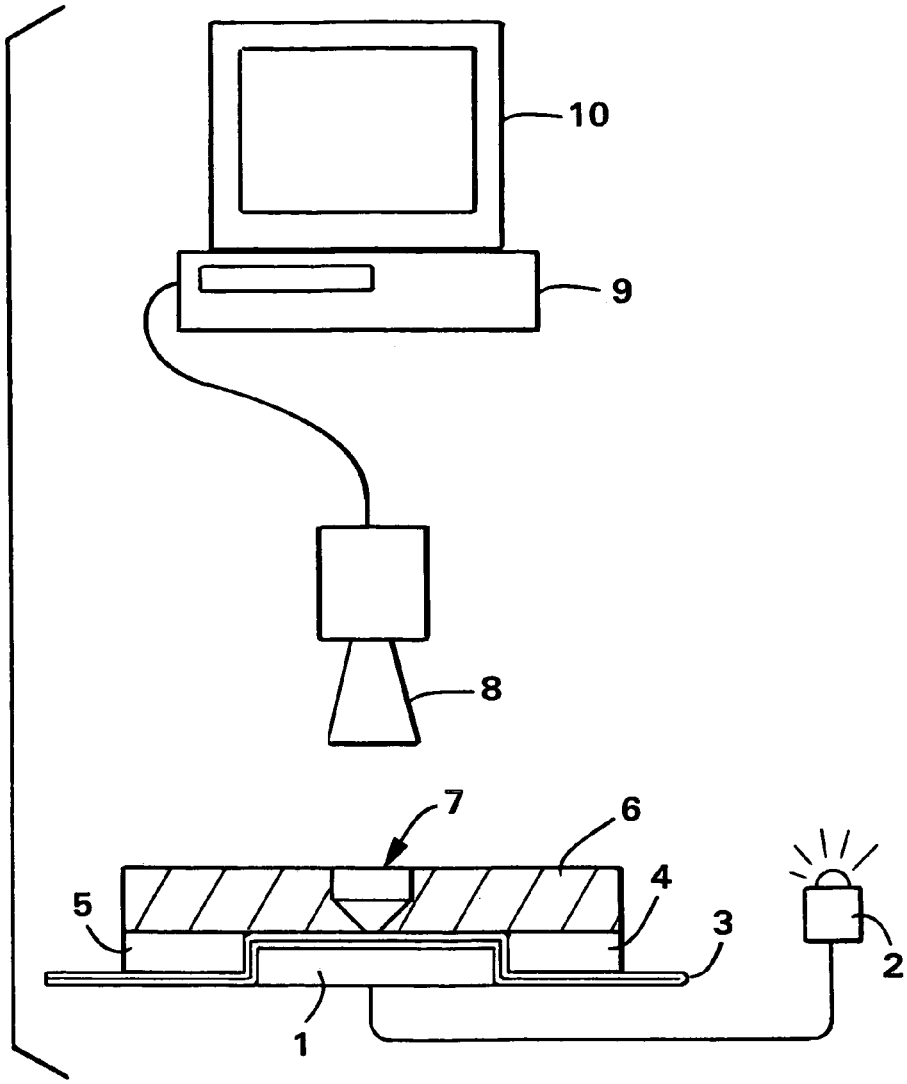
FIG. 9 is a schematic representation of the apparatus used to measure the Wet Through Time and the Wet Out Area.

Referring to FIG. 9, the method for determining the Wet Through Time and the Wet Out Area will be described in more detail. The test is also fully described in U.S. Pat. No. 6,054,020, entitled Soft Absorbent Tissue Products Having Delayed Moisture Penetration, issued to Goulet et al. and herein incorporated by reference. In general, the method involves placing a measured amount of a dyed liquid on the top surface of a tissue sample and measuring the time it takes for the liquid to pass through the sample to activate a moisture sensor positioned on the bottom of the tissue. That time is the Wet Through Time. Once the Wet Through Time is reached, the extent to which the dyed liquid will have wicked in the x-y direction of the tissue will be visible as a circular or elliptical spot. The area of the spot is the Wet Out Area.

Figure 10:
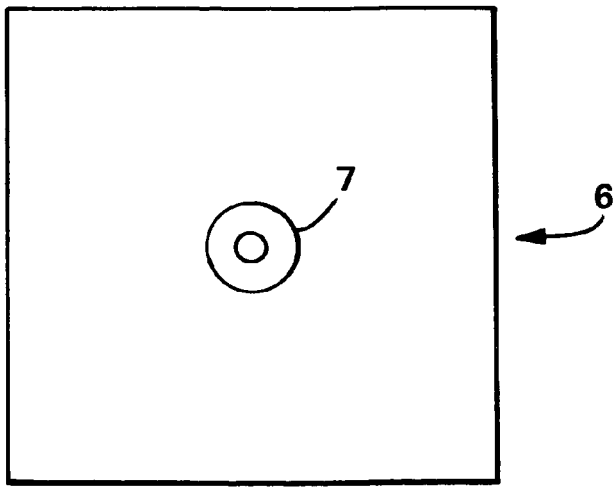
FIG. 10 is a plan view of the sample cover illustrated in FIG. 9.

FIG. 9 schematically illustrates the equipment set-up for carrying out the test procedure. Shown is a moisture sensor 1 which rests on a flat surface and is connected to a moisture light indicator 2. (The specific moisture sensor is a Cole-Parmer Liqui-Sense Controller 77096-00 manufactured by Barnant Company, Barrington, Ill., with a Cole-Parmer Liqui-Sense Sensor 77095-00.) The sensitivity of the moisture sensor is calibrated to respond to 0.2 milliliter of the test liquid (described below) per the manufacturer's instructions. The tissue sample 3, which has been folded in half and placed on top of the moisture sensor, is secured with two Lexan side weights 4 and 5 placed on both sides of the moisture sensor. Each side weight measures ¾ inch by ¼ inch in cross-section and is 4 inches long. These weights are placed such that the folded tissue sample rests flat against the surface of the moisture sensor but is not under tension. On top of the sample is placed a 4 inch by 4 inch by ½ inch Lexan sample cover 6 as further illustrated in FIG. 10. The sample cover has a conical hole 7 through the center measuring ⅜ inch in diameter on the top surface and 1/16 inch in diameter at the bottom surface. Because the thickness of the moisture sensor is slightly less than the ¼ inch thickness of the side weights, the sample holder primarily rests on the side weights. The conical hole 7 is positioned so as to reside over at least one aperture of the hydrophobic outer layer, ply or surface.

Positioned above the sample cover is a video camera 8 (JVC TK-1070U Color Video Camera made in Japan by JVC or equivalent). The video camera output is connected to a video cassette recorder 9 (Panasonic AG-1 960 Proline distributed by Panasonic Industrial Co., Secaucus, N.J. or equivalent) and a color monitor 10 (Panasonic CT-1 381-Y Color Video Monitor or equivalent). The video camera is positioned on a tripod such that the moisture light indicator 2 is visible within the view of the video camera.

The test liquid used to conduct the testing is Hercules Size Tester Green Dye, available from Hercules Incorporated, Wilmington, Del. The test liquid has the following properties measured at 22.degree. C.: viscosity of 10 centipoise when measured using a Brookfield Synchrolectric Viscometer model RVT with spindle No. 1 at a speed of 50 rpm; surface tension of 60.5 dynes per centimeter when measured using a duNouy ring tensiometer (Fisher Scientific Surface Tensiometer 20); pH of 7.3; and a specific conductance of 18 micro Siemens per centimeter.

To carry out the testing to determine the Wet Through Time and the Wet Out Area, the video picture is adjusted so that the picture of the sample cover measures 6 inches by 6 inches on the video monitor. The LiquiSense controller unit is positioned such that the alarm light (moisture indicator light) can be clearly seen on the video screen. A sample of the tissue product to be tested is folded in half, placed over the moisture sensor, secured with the side weights, and covered with the sample cover as previously shown and described. The video cassette recorder (VCR) is started. Using a micro-pipette, 0.5 milliliter of the test liquid is placed in the hole 5 of the sample cover and timing of the test is begun. When the moisture monitor alarm light is activated, the elapsed time in seconds is the Wet Through Time for that sample. After that point the VCR is stopped. Using the video jog and pause features, the video image is adjusted to the frame where the alarm was activated, showing the size of the spot created by the dyed test liquid. The area of the dye image on the video screen at that point in time, expressed in square inches, is the Wet Out Area. Because the shape of the dye images is generally elliptical, the area can readily be determined by measuring the major and minor axis of the ellipse and calculating the area. However, if greater precision is desired, it will be appreciated that it is also possible to calculate the area using more sophisticated image analysis techniques.

Wet Out Time

As used herein, "Wet Out Time" is a measure of how fast the tissue product absorbs water and reaches its absorbent capacity, expressed in seconds. In particular, the Wet Out Time is determined by selecting and cutting twenty (20) representative tissue product samples into squares measuring 63 millimeters by 63 millimeters (±3 mm.) after first conditioning the tissue product at 23.0° C.±1.0° C. and 50.0 percent±2.0 percent relative humidity for a period of at least 4 hours. The resulting twenty sample products are assembled into a test specimen pad by stacking the twenty individual samples one atop another while aligning their edges forming a specimen pad.

For multi-ply products having distinct hydrophobic and hydrophilic plies, the Wet Out Time of each ply can be determined separately by de-plying the tissue products and then testing specimen pads formed from plies taken from the same location within the multi-ply tissue product. Thus, one can determine the Wet Out Time of an individual ply or of the entire multi-ply product.

The specimen pad is then stapled together across each corner of the specimen pad just far enough from the edges to hold the staples. The staples should be oriented diagonally across each corner and should not wrap around the edges of the test specimen. With the staple points facing down, the specimen pad is held horizontally, approximately 25 millimeters from the surface of a pan of distilled or deionized water at a temperature of 23° C.±3° C. The pan should be large enough and filled with water deep enough to initially float the specimen pad without touching the edges or bottom of the pan. The specimen pad is dropped flat onto the surface of the water and the time for the specimen pad to become completely visually saturated with water is recorded. This time, measured to the nearest 0.1 second, is the Wet Out Time for the specimen pad. At least five (5) replicate measurements are made by assembling a new specimen pad from the same tissue product material to yield a reliable average. The reliable average is reported as the Wet Out Time in seconds.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A tissue product comprising one or more plies, wherein each ply within the tissue product is a tissue ply having from about 80 to about 100 percent cellulose fibers, said tissue product further comprising:

an upper hydrophobic exterior layer having an upper exterior surface;

a hydrophilic interior layer;

a plurality of apertures extending from the upper exterior surface in fluid communication with the hydrophilic interior layer;

a lower hydrophobic exterior layer having a lower exterior surface; and a plurality of apertures extending from the lower exterior surface in fluid communication with the hydrophilic interior layer.

2. The tissue product of claim 1 wherein the tissue product comprises a single ply having multiple layers.

3. The tissue product of claim 1 wherein the tissue product comprises more than one ply.

4. The tissue product of claim 3 wherein the upper hydrophobic exterior layer, the hydrophilic interior layer, and the lower hydrophobic exterior layer comprise an entire thickness of a ply of tissue.

5. The tissue product of claim 4 wherein the apertures extend completely through the upper and lower hydrophobic exterior layers.

6. The tissue product of claim 3 wherein the upper hydrophobic exterior layer, the hydrophilic interior layer, and the lower hydrophobic exterior layer comprise one or more layers of a ply of tissue.

7. The tissue product of claim 3 further comprising:

a hydrophobic interior layer; and a plurality of apertures located in the hydrophobic interior layer extending at least through the hydrophobic interior layer.

8. The tissue product of claim 3 wherein the apertures contain hydrophilic fibers pulled through the apertures from the hydrophilic interior layer.

9. The tissue product of claim 2 or 3 wherein the apertures have a frequency and the frequency is between about 3 to about 800 apertures per lineal inch.

10. The tissue product of claim 2 or 3 wherein the apertures have an area and the area is between about 0.0001 $mm^2$ to about 8 $mm^2$.

11. The tissue product of claim 2 or 3 wherein the apertures are tapered, and the size of the apertures is greater at the exterior surfaces than the size of the apertures near the hydrophilic layer.

12. The tissue product of claim 2 or 3 wherein a total caliper of the tissue product is about 600 microns or less.

13. The tissue product of claim 2 or 3 having a Hercules Size Test value of about 10 seconds to about 300 seconds and a Water Drop Time of about 0 seconds to about 10 seconds.

14. The tissue product of claim 2 or 3 having a Hercules Size Test value of about 25 seconds to about 300 seconds and a Water Drop Time of about 0 seconds to about 7 seconds.

15. The tissue product of claim 2 or 3 having a Hercules Size Test value of about 10 seconds to about 300 seconds and an Automatic Gravimetric Absorbency Test value of about 0.7 seconds to about 5 seconds.

16. The tissue product of claim 2 or 3 wherein a Wet Through Time for the tissue is between about 20 seconds to about 60 seconds, a Water Drop Time is between about 0 seconds to about 10 seconds, and a Wet Out Area is about 3 square inches or greater.

17. The tissue product of claim 1 wherein the apertures in the upper exterior surface are offset relative to the apertures in the lower exterior surface.

18. The tissue product of claim 1 wherein the upper hydrophobic exterior layer comprises a polysiloxane.

19. The tissue product of claim 1 wherein both the upper and lower hydrophobic exterior layers comprise a polysiloxane.

20. The tissue product of claim 18 or 19 wherein the polysiloxane comprises an amino functional polysiloxane.

21. The tissue product of claim 18 or 19 wherein the polysiloxane comprises an amount between about 0.3 percent to about 4 percent by weight of the total dry fiber in the product.

22. The tissue product of claim 1 comprising a basis weight for each layer and the basis weight of the hydrophilic interior layer is greater than the basis weight of the upper and lower hydrophobic exterior layers.

23. The tissue product of claim 22 wherein the basis weight of the hydrophilic interior layer is about 25 percent to about 300 percent greater than that of outer hydrophobic layers or plies.

24. The tissue product of claim 1 comprising a tensile strength and the tensile strength is between about 300 g/3" to about 3,000 gram/3".

* * * * *